US011240598B2

(12) United States Patent
Lambert et al.

(10) Patent No.: US 11,240,598 B2
(45) Date of Patent: Feb. 1, 2022

(54) BAND-LIMITED BEAMFORMING MICROPHONE ARRAY WITH ACOUSTIC ECHO CANCELLATION

(71) Applicant: ClearOne, Inc., Salt Lake City, UT (US)

(72) Inventors: David K. Lambert, South Jordan, UT (US); Russell S. Ericksen, Spanish Fork, UT (US); Derek L. Graham, South Jordan, UT (US)

(73) Assignee: ClearOne, Inc., Salt Lake City, UT (US)

( * ) Notice: Subject to any disclaimer, the term of this patent is extended or adjusted under 35 U.S.C. 154(b) by 0 days.

(21) Appl. No.: 16/536,456

(22) Filed: Aug. 9, 2019

(65) Prior Publication Data

US 2019/0371353 A1 Dec. 5, 2019

Related U.S. Application Data

(63) Continuation of application No. 15/062,064, filed on Mar. 5, 2016, now Pat. No. 10,397,697, which is a (Continued)

(51) Int. Cl.
*H04R 1/40* (2006.01)
*H04R 1/08* (2006.01)

(Continued)

(52) U.S. Cl.
CPC ..... *H04R 1/406* (2013.01); *G10L 21/0232* (2013.01); *H04R 1/08* (2013.01);

(Continued)

(58) Field of Classification Search
None
See application file for complete search history.

(56) References Cited

U.S. PATENT DOCUMENTS 4,330,691 A 5/1982 Gordon
4,365,449 A 12/1982 Liautaud (Continued)

FOREIGN PATENT DOCUMENTS

CA 2838856 A1 12/2012
CA 2846323 A1 9/2014

(Continued)

OTHER PUBLICATIONS

District Court Litigation, "Memorandum Opinion and Order on Claim Construction", *Shure, Inc.* v. *ClearOne, Inc.* 1:17-cv-03078 (N.D. III—Eastern Division), Document No. 613, Aug. 25, 2019, 20.

(Continued)

*Primary Examiner* — Kenny H Truong
(74) *Attorney, Agent, or Firm* — Matthew J Booth PC; Matthew J. Booth

(57) ABSTRACT

This disclosure describes an apparatus and method of an embodiment of an invention that is a band-limited beamforming microphone array with acoustic echo cancellation that includes: a plurality of first microphones configured as a beamforming microphone array to resolve first audio input signals within a first frequency range, the beamforming microphone array includes acoustic echo cancellation; one or more additional microphone(s) configured to resolve second audio input signals within a restricted second frequency range such that the additional microphone(s) are coupled to the beamforming microphone array; augmented beamforming that processes audio signals from the beamforming microphone array and the additional microphone(s).

28 Claims, 7 Drawing Sheets

Related U.S. Application Data continuation of application No. 14/276,438, filed on May 13, 2014, now Pat. No. 9,294,839, which is a continuation of application No. 14/191,511, filed on Feb. 27, 2014, now abandoned.

(60) Provisional application No. 61/828,524, filed on May 29, 2013, provisional application No. 61/771,751, filed on Mar. 1, 2013.

(51) Int. Cl.

| | |
|---|---|
| ***G10L 21/0232*** | (2013.01) |
| ***H04R 29/00*** | (2006.01) |
| ***H04R 3/00*** | (2006.01) |
| ***H04R 17/02*** | (2006.01) |
| ***H04R 3/04*** | (2006.01) |
| ***H04R 1/28*** | (2006.01) |
| ***H04R 31/00*** | (2006.01) |
| ***G10L 21/0208*** | (2013.01) |

(52) U.S. Cl.

CPC ..... *H04R 1/2876* (2013.01); *H04R 3/005* (2013.01); *H04R 3/04* (2013.01); *H04R 17/02* (2013.01); *H04R 29/005* (2013.01); *H04R 31/006* (2013.01); *G10L 2021/02082* (2013.01); *H04R 2201/021* (2013.01); *H04R 2420/07* (2013.01); *H04R 2430/21* (2013.01); *H04R 2430/23* (2013.01)

(56) References Cited

U.S. PATENT DOCUMENTS

| | | | |
|---|---|---|---|
| 5,008,574 | A | 4/1991 | Kitahata |
| 6,332,029 | B1 | 12/2001 | Azima et al. |
| 6,741,720 | B1 | 5/2004 | Myatt |
| 6,944,312 | B2 | 9/2005 | Mason et al. |
| 8,061,359 | B2 | 11/2011 | Emanuel |
| 8,229,134 | B2 | 7/2012 | Duraiswami et al. |
| 8,259,959 | B2 | 9/2012 | Marton et al. |
| 8,286,749 | B2 | 10/2012 | Stewart, Jr. et al. |
| 8,297,402 | B2 | 10/2012 | Stewart et al. |
| 8,403,107 | B2 | 3/2013 | Stewart, Jr. et al. |
| 8,472,640 | B2 | 6/2013 | Marton |
| 8,479,871 | B2 | 7/2013 | Stewart et al. |
| 8,515,109 | B2 | 8/2013 | Dittberner et al. |
| 8,631,897 | B2 | 1/2014 | Stewart, Jr. et al. |
| 8,672,087 | B2 | 3/2014 | Stewart, Jr. et al. |
| 9,565,493 | B2 | 2/2017 | Abraham et al. |
| 9,813,806 | B2 | 11/2017 | Graham et al. |
| 9,826,211 | B2 | 11/2017 | Sawa et al. |
| 10,397,697 | B2 | 8/2019 | Lambert et al. |
| 10,728,653 | B2 | 7/2020 | Graham et al. |
| 2002/0159603 | A1 | 10/2002 | Hirai et al. |
| 2003/0107478 | A1 | 6/2003 | Hendricks et al. |
| 2003/0118200 | A1 | 6/2003 | Beaucoup et al. |
| 2003/0185404 | A1 | 10/2003 | Milsap |
| 2006/0088173 | A1 | 4/2006 | Rodman et al. |
| 2008/0168283 | A1 | 7/2008 | Penning |
| 2008/0253589 | A1 | 10/2008 | Trahms |
| 2008/0260175 | A1 | 10/2008 | Elko et al. |
| 2009/0147967 | A1 | 6/2009 | Ishibashi et al. |
| 2009/0173030 | A1 | 7/2009 | Gulbrandsen |
| 2009/0173570 | A1 | 7/2009 | Levit et al. |
| 2010/0119097 | A1 | 5/2010 | Ohtsuka |
| 2010/0215189 | A1 | 8/2010 | Marton |
| 2011/0007921 | A1 | 1/2011 | Stewart, Jr. et al. |
| 2011/0096631 | A1* | 4/2011 | Kondo ..... H04R 1/406 367/117 |
| 2011/0268287 | A1 | 11/2011 | Ishibashi |
| 2011/0311085 | A1 | 12/2011 | Stewart, Jr. et al. |
| 2012/0002835 | A1 | 1/2012 | Stewart, Jr. et al. |
| 2012/0076316 | A1 | 3/2012 | Zhu et al. |
| 2012/0080260 | A1 | 4/2012 | Stewart, Jr. et al. |
| 2012/0155688 | A1 | 6/2012 | Wilson |
| 2012/0169826 | A1 | 7/2012 | Jeong |
| 2012/0224709 | A1 | 9/2012 | Keddem et al. |
| 2012/0327115 | A1 | 12/2012 | Chhetri et al. |
| 2013/0004013 | A1 | 1/2013 | Stewart, Jr. et al. |
| 2013/0015014 | A1 | 1/2013 | Stewart et al. |
| 2013/0016847 | A1 | 1/2013 | Steiner |
| 2013/0029684 | A1 | 1/2013 | Kawaguchi et al. |
| 2013/0147835 | A1 | 6/2013 | Lee et al. |
| 2013/0206501 | A1 | 8/2013 | Yu et al. |
| 2013/0251181 | A1 | 9/2013 | Stewart, Jr. et al. |
| 2013/0264144 | A1 | 10/2013 | Hudson et al. |
| 2013/0336516 | A1 | 12/2013 | Stewart et al. |
| 2013/0343549 | A1 | 12/2013 | Vemireddy et al. |
| 2014/0037097 | A1 | 2/2014 | LaBosco |
| 2014/0098964 | A1 | 4/2014 | Rosca et al. |
| 2014/0233778 | A1 | 8/2014 | Hardman et al. |
| 2014/0265774 | A1 | 9/2014 | Stewart, Jr. et al. |
| 2014/0286518 | A1 | 9/2014 | Stewart, Jr. et al. |
| 2014/0301586 | A1 | 10/2014 | Stewart, Jr. et al. |
| 2014/0341392 | A1 | 11/2014 | Lambert et al. |
| 2014/0357177 | A1 | 12/2014 | Stewart, Jr. et al. |
| 2015/0078582 | A1 | 3/2015 | Graham et al. |
| 2016/0302002 | A1 | 10/2016 | Lambert et al. |
| 2017/0134850 | A1 | 5/2017 | Graham et al. |
| 2018/0160224 | A1 | 6/2018 | Graham et al. |
| 2019/0371353 | A1 | 12/2019 | Lambert et al. |

FOREIGN PATENT DOCUMENTS

| | | | |
|---|---|---|---|
| CN | 102821336 | A | 12/2012 |
| CN | 102833664 | A | 12/2012 |
| CN | 104080289 | A | 10/2014 |
| CN | 102821336 | B | 1/2015 |
| EP | 2721837 | A1 | 4/2014 |
| EP | 2778310 | A1 | 9/2014 |
| JP | 2007274131 | A | 10/2007 |
| KR | 100901464 | B1 | 6/2009 |
| WO | 9911184 | A1 | 3/1999 |
| WO | 2011104501 | A2 | 9/2011 |
| WO | 2012174159 | A1 | 12/2012 |

OTHER PUBLICATIONS

IPR, "Decision Granting Institution of Inter Partes Review", *ClearOne, Inc.* v *Shure Acquisition Holdings, Inc.*, IPR IPR2019-00683 (PTAB), Paper No. 21, Aug. 16, 2019, 37.

Advanced Network Devices, "IP Speaker—IPSCM", Feb. 2011, 2.

Audix Microphones, "Audix Introduces Innovative Ceiling Mics", Jun. 2011, 6.

Clearone, Inc., "Beamforming Microphone Array", Mar. 2012, 6.

Clearone, Inc., "Ceiling Microphone Array Installation Manual", Jan. 9, 2012, 20.

CTG Audio, "Ceiling Microphone CTG CM-01", Jun. 5, 2008, 2.

CTG Audio, "Installation Manual", Nov. 21, 2008, 25.

District Court Litigation, "Memorandum Opinion and Order for Preliminary Injunction", *Shure, Inc.* v. *ClearOne, Inc.* 1:17-cv-03078 (N.D. III—Eastern Division), Document No. 0551, Aug. 5, 2019, 65.

District Court Litigation, "Motion by Counter Claimant ClearOne Inc. for Preliminary Injunction", *Shure, Inc.* v. *ClearOne, Inc.* 1:17-cv-03078 (N.D. III—Eastern Division), Document No. 0295, Apr. 17, 2018, 31.

District Court Litigation, "Shure Incorporated's Initial Non-Infringement, Unenforceability, and Invalidity Contentions related to U.S. Pat. No. 9,813,806 Pursuant to Local Patent Rule 2.3", *Shure, Inc.* v. *ClearOne, Inc.* 1:17-cv-03078 (N.D.III—Eastern Division), Document No. 0307, Apr. 23, 2018, 116.

IPR, "Declaration of Durand R. Begault, Ph.D., In Support of Petition for Inter Partes Review of U.S. Pat. No. 9,565,493", *ClearOne, Inc.* v *Shure Acquisition Holdings, Inc.*, IPR IPR2019-00683 (PTAB), Exhibit No. 1003, Feb. 15, 2019, 139.

IPR, "Petition for Inter Partes Review of U.S. Pat. No. 9,565,493", *ClearOne, Inc.* v *Shure Acquisition Holdings, Inc.*, IPR IPR2019-00683 (PTAB), Paper No. 1, Feb. 15, 2019, 114.

(56) References Cited

OTHER PUBLICATIONS

Lnvensense Inc., "Microphone Array Beamforming", Dec. 31, 2013, 1-12.
Sasaki, et al., "A Predefined Command Recognition System Using a Ceiling Microphone Array in Noisy Housing Environments", 2008 IEEE/RSJ International Conference on Intelligent Robots and Systems, Sep. 22-26, 2008, 7.
Soda, et al., "Introducing Multiple Microphone Arrays for Enhancing Smart Home Voice Control", The Institute of Electronics, Information and Communication Engineers, Technical Report of IEICE., Jan. 23-25, 2013, 7.
District Court Litigation, "Clearone's Opposition to Shure's Motion to Supplement Final Nvalidity Contentions as to the '186 Patent", *Shure, Inc.* v. *ClearOne, Inc.* 1:17-cv-03078 (N.D. III—Eastern Division), Document No. 702, Jan. 13, 2020, 142.
District Court Litigation, "Memorandum in support of Shure Incorporated's Motion to Supplement Final Invalidity Contentions as to the '186 Patent", *Shure, Inc.* v. *ClearOne, Inc.* 1:17-cv-03078 (N.D. III—Eastern Division), Document No. 695, Dec. 30, 2019, 116.
IPR, "File History of U.S. Appl. No. 15/218,297 Part 1 of 4", *ClearOne, Inc.* v *Shure Acquisition Holdings, Inc.*, IPR IPR2019-00683 (PTAB), Exhibit 2030, Mar. 13, 2020, 254.
IPR, "File History of U.S. Appl. No. 15/218,297 Part 2 of 4", *ClearOne, Inc.* v *Shure Acquisition Holdings, Inc.*, IPR IPR2019-00683 (PTAB), Exhibit 2030, Mar. 13, 2020, 263.
IPR, "File History of U.S. Appl. No. 15/218,297 Part 3 of 4", *ClearOne, Inc.* v *Shure Acquisition Holdings, Inc.*, IPR. IPR2019-00683 (PTAB), Exhibit 2030, Mar. 13, 2020, 250.
IPR, "File History of U.S. Appl. No. 15/218,297 Part 4 of 4", *ClearOne, Inc.* v *Shure Acquisition Holdings, Inc.*, IPR IPR2019-00683 (PTAB), Exhibit 2030, Mar. 13, 2020, 241.
IPR, "Patent Owner Sur Reply", *ClearOne, Inc.* v *Shure Acquisition Holdings, Inc.*, IPR IPR2019-00683 (PTAB), Paper No. 58, Mar. 13, 2020, 32.
IPR, "Patent Owners Revised Contingent Motion to Amend", *ClearOne, Inc.* v *Shure Acquisition Holdings, Inc.*, IPR IPR2019-00683 (PTAB), Paper No. 57, Mar. 13, 2020, 42.
IPR, "Supplemental Declaration of Dr Jeffrey S Vipperman", *ClearOne, Inc.* v *Shure Acquisition Holdings, Inc.*, IPR IPR2019-00683 (PTAB), Exhibit 2029, Mar. 13, 2020, 55.
Armstrong, "Excerpts from Armstrong, 2011 2012 Ceiling Wall Systems Catalog", *Shure, Inc.* v. *ClearOne, Inc.*, PGR2020-00079 (P.T.A.B.), Exhibit 1019, as early as 2012, 162.
CTG Audio, "CTG FS-400 and RS-800 with "Beamforming" Technology Datasheet", CTG FS-400 and RS-800 with "Beamforming" Technology Datasheet, as early as 2009, 2.
CTG Audio, "CTG User Manual for the FS- 400/800 Beamforming Mixers", CTG User Manual for the FS- 400/800 Beamforming Mixers, Nov. 21, 2008, 26.
CTG Audio, "Frequently Asked Questions", *Shure, Inc.* v. *ClearOne, Inc.*, PGR2020-00079 (P.T.A.B.), Exhibit 1015, as early as 2009, 2.
CTG Audio, "Installation Manual and User Guidelines for the Soundman SM 02 System", *Shure, Inc.* v. *ClearOne, Inc.*, PGR2020-00079 (P.T.A.B.), Exhibit 1026, as early as 2001, 29.
CTG Audio, "Introducing the CTG FS-400 and FS-800 with Beamforming Technology", *Shure, Inc.* v. *ClearOne, Inc.*, PGR2020-00079 (P.T.A.B.), Exhibit 1027, as early as 2008, 2.
CTG Audio, "Meeting the Demand for Ceiling Mics in the Enterprise 5 Best Practices", *Shure, Inc.* v. *ClearOne, Inc.*, PGR2020-00079 (P.T.A.B.), Exhibit 1014, at least as early as 2012, 9.
District Court Litigation, "Clearone's Opposition to Shure's Motion for Summary Judgment on Invalidity and Memorandum in Support of its Cross Motion for Summary Judgment of Validity and Enforceability of U.S. Pat. Nos. 9,635,186 and 9,813,806", *Shure, Inc.* v. *ClearOne, Inc.* 1:17-cv-03078 (N.D. III—Eastern Division), Document No. 898, Aug. 12, 2020, 93.
District Court Litigation, "ClearOne's Reply in Support of its MSJ of Validity and Enforceability of USPN '186 and '806", *Shure, Inc.* v. *ClearOne, Inc.* 1:17-cv-03078 (N.D. III—Eastern Division), Document No. 950, Sep. 29, 2020, 27.
District Court Litigation, "ClearOne's Responses to Shure's Statement of Uncontested Facts", *Shure, Inc.* v. *ClearOne, Inc.* 1:17-cv-03078 (N.D. III—Eastern Division), Document No. 951, Sep. 29, 2020, 40.
District Court Litigation, "ClearOne's Amended Final Patent Enforceability and Validity Contentions for the Graham Patent", *Shure, Inc.* v. *ClearOne, Inc.* 1:17-cv-03078 (N.D. III—Eastern Division), Document No. 852-5, Jul. 9, 2020, 74.
District Court Litigation, "ClearOne's Response to Shure's Statement of Uncontested Material Facts", *Shure, Inc.* v. *ClearOne, Inc.* 1:17-cv-03078 (N.D. III—Eastern Division), Document No. 897, Aug. 12, 2020, 27.
District Court Litigation, "ClearOne's Statement of Undisputed Material Facts", *Shure, Inc.* v. *ClearOne, Inc.* 1:17-cv-03078 (N.D. III—Eastern Division), Document No. 896, Aug. 12, 2020, 48.
District Court Litigation, "Deposition Transcript of Larry Nixon", *Shure, Inc.* v. *ClearOne, Inc.* 1:17-cv-03078 (N.D. III—Eastern Division), Document No. 852-20, Jul. 9, 2020, 84.
District Court Litigation, "Larry S. Nixon Expert Report", *Shure, Inc.* v. *ClearOne, Inc.* 1:17-cv-03078 (N.D. III—Eastern Division), Document No. 852-18, Jul. 9, 2020, 143.
District Court Litigation, "Rebuttal Report prepared of Dan Schonfeld", *Shure, Inc.* v. *ClearOne, Inc.* 1:17-cv-03078 (N.D. III—Eastern Division), Document No. 901-3 (Exhibit 199), Aug. 12, 2020, 126.
District Court Litigation, "Shure Incorporated's Memorandum of Law in Support of its Motion for Summary Judgment on Invalidity", *Shure, Inc.* v. *ClearOne, Inc.* 1:17-cv-03078 (N.D. III—Eastern Division), Document No. 849, Jul. 9, 2020, 50.
District Court Litigation, "Shure's Supplemental Final Invalidity and Non-Infringement Contentions as to the 186 Patent and Final Invalidity Contentions as to the '806 Patent After Claim Construction", *Shure, Inc.* v. *ClearOne, Inc.* 1:17-cv-03078 (N.D. III—Eastern Division), Document No. 901-2, Aug. 12, 2020, 23.
District Court Litigation, "Shure's Consolidated Final Unenforceability and Invalidity Contentions", *Shure, Inc.* v. *ClearOne, Inc.* 1:17-cv-03078 (N.D. III—Eastern Division), Document No. 901-3 (Exhibit 198), Aug. 12, 2020, 64.
District Court Litigation, "Shure's Combined Reply and Response to ClearOne's Cross-Motion for Summary Judgment on Issues Relating to Invalidity and Unenforceability", *Shure, Inc.* v. *ClearOne, Inc.* 1:17-cv-03078 (N.D. III—Eastern Division), Document No. 914, Sep. 11, 2020, 70.
District Court Litigation, "Shure's Consolidated Final Unenforceability and Invalidity Contentions Related to USPN 9813806", *Shure, Inc.* v. *ClearOne, Inc.* 1:17-cv-03078 (N.D. III—Eastern Division), Document No. 901-1, Aug. 12, 2020, 44.
District Court Litigation, "Shure's Response to ClearOne's Statement of Facts", *Shure, Inc.* v. *ClearOne, Inc.* 1:17-cv-03078 (N.D. III—Eastern Division), Document No. 902, Aug. 12, 2020, 83.
District Court Litigation, "Shure's Statement of Uncontested Material Facts", *Shure, Inc.* v. *ClearOne, Inc.* 1:17-cv-03078 (N.D. III—Eastern Division), Document No. 850, Jul. 9, 2020, 22.
District Court Litigation, "Shure's Support of its Combined Reply and Response to ClearOne's Cross Motion br Summary Judgment on Issues Relating to Invalidity and Unenforceability", *Shure, Inc.* v. *ClearOne, Inc.* 1:17-cv-03078 (N.D. III—Eastern Division), Document No. 915, Sep. 11, 2020, 29.
Post Grant Review, "Declaration of Jeffrey S. Vipperman", *Shure, Inc.* v. *ClearOne, Inc.*, PGR2020-00079 (P.T.A.B.), Exhibit 1002, Jul. 28, 2020, 159.
Post Grant Review, "Petition for Post Grant Review", *Shure, Inc.* v. *ClearOne, Inc.*, PGR2020-00079 (P.T.A.B.), Document No. 1, Jul. 28, 2020, 113.
The Enright Company, "Scanlines (Jun. 2009)", *Shure, Inc.* v. *ClearOne, Inc.*, PGR2020-00079 (P.T.A.B.), Exhibit 1028, Jun. 2009, 9.
PGR2020-00079 Exhibit 1036, "Second Declaration of Dr Jeffrey S Vipperman", *Shure, Inc.* v. *ClearOne, Inc.*, PGR2020-00079 (P.T.A.B.), Exhibit 1029, Aug. 3, 2021, 60.
Fed Cir Appeal 21-1024 Doc No. 17, "Plaintiff-Appellant's Opening Brief", *Shure, Inc.* v *ClearOne, Inc.*, 21-1024 (Fed. Cir. 2020), Document No. 17, Dec. 30, 2020, 136.

(56) References Cited

OTHER PUBLICATIONS

Fed Cir Appeal 21-1024 Doc No. 32, "Non-Confidential Response Brief of Defendant-Appellee Clearone, Inc.", *Shure, Inc.* v. *ClearOne, Inc.*, 21-1024 (Fed. Cir. 2020), Document No. 32, Mar. 10, 2021, 87.
Fed Cir Appeal 21-1024 Doc No. 36, "Plaintiff-Appellant'S Reply Brief ", *Shure, Inc.* v *ClearOne, Inc.*, 21-1024 (Fed. Cir. 2020), Document No. 36, Apr. 12, 2021, 45.
Fed Cir Appeal 21-1024 Doc No. 43-1, "Corrected Non-Confidential Joint Appendix", *Shure, Inc.* v *ClearOne, Inc.*, 21-1024 (Fed. Cir. 2020), Document No. 43-1, Apr. 23, 2021, 437.
PGR2020-00079 Doc No. 10, "Patent Owner Preliminary Response", *Shure, Inc.* v. *ClearOne, Inc.*, PGR2020-00079 (P.T.A.B.), Document No. 10, Nov. 17, 2020, 92.
PGR2020-00079 Doc No. 12, "Petitioner's Reply to Patent Owner's Preliminary Response", *Shure, Inc.* v *ClearOne, Inc.*, PGR2020-00079 (P.T.A.B.), Document No. 12, Dec. 23, 2020, 12.
PGR2020-00079 Doc No. 13, "Patent Owner's Preliminary Surreply", *Shure, Inc.* v. *ClearOne, Inc.*, PGR2020-00079 (P.T.A.B.), Document No. 13, Jan. 6, 2021, 12.
PGR2020-00079 Doc No. 14, "Granting Institution of Post-Grant Review", *Shure, Inc.* v. *ClearOne, Inc.*, PGR2020-00079 (P.T.A.B.), Document No. 14, Feb. 16, 2021, 76.
PGR2020-00079 Doc No. 25, "Patent Owners Contingent Motion to Amend and Request for Preliminary Guidance", *Shure, Inc.* v. *ClearOne, Inc.*, PGR2020-00079 (P.T.A.B.), Document No. 25, May 11, 2021, 33.
PGR2020-00079 Doc No. 27, "Response", *Shure, Inc.* v. *ClearOne, Inc.*, PGR2020-00079 (P.T.A.B.), Document No. 27, May 11, 2021, 97.
PGR2020-00079 Doc No. 30, "Petitioners Reply to Patent Owner's Response", *Shure, Inc.* v. *ClearOne, Inc.*, PGR2020-00079 (P.T.A.B.), Document No. 30, Aug. 4, 2021, 34.
PGR2020-00079 Doc No. 31, "Petitioner's Opposition to Patent Owner's Contingent Motion to Amend and Request for Preliminary Guidance", *Shure, Inc.* v. *ClearOne, Inc.*, PGR2020-00079 (P.T.A.B.), Document No. 31, Aug. 4, 2021, 30.
PGR2020-00079 Exhibit 1036, "Diethorn, Eric J. "Chapter 4: Subband Noise Reduction Methods for Speech Enhancement." Audio Signal Processing for Next-Generation Multimedia Communication Systems, edited by Yiteng Huang and Jacob Benesty, Kluwer Academic Publishers, 2004", *Shure, Inc.* v *ClearOne, Inc.*, PGR2020-00079 (P.T.A.B.), Exhibit 1036, Aug. 3, 2021, 22.
PGR2020-00079 Exhibit 1037, "Warsitz, Ernst, and Haeb-Umbach, Reinhold. "Blind Acoustic Beamforming Based on Generalized Eigenvalue Decomposition." IEEE Transactions on Audio, Speech and Language Processing, vol. 15, No. 5, 2007, pp. 1529-1539", *Shure, Inc.* v. *ClearOne, Inc.*, PGR2020-00079 (P.T.A.B.), Exhibit 1037, Aug. 3, 2021, 11.
PGR2020-00079 Exhibit 1038, "Transcript of the deposition of Dr. Durand Begault, taken on Jul. 1, 2021", *Shure, Inc.* v *ClearOne, Inc.*, PGR2020-00079 (P.T.A.B.), Exhibit 1038, Aug. 3, 2021, 262.
Benesty, J., et al, "Microphone Array Signal Processing," pp. 1-7 & 39-65 Springer (2010).
Brandstein, et al., "Microphone Arrays: Signal Processing Techniques and Applications", Digital Signal Processing, Springer-Verlag Berlin Heidelberg, 2001, pp. 1-401, 2001, pp. 1-401.
DCT 1:17-cv-03078 Doc. No. 0901-3 Ex 196, "Opening Expert Report of Dr. Wilfrid Leblanc", *Shure, Inc.* v. *ClearOne, Inc.* 1:17-cv-03078 (N.D. III—Eastern Division), Document No. 901-3 (Exhibit 196), Aug. 12, 2020, 609.
DCT 1:17-cv-03078 Doc. No. 0912, "Memorandum Opinion and Order", *Shure, Inc.* v. *ClearOne, Inc.* 1:17-cv-03078 (N.D. III—Eastern Division), Document No. 912, Sep. 1, 2020, 35.
DCT 1:17-cv-03078 Doc. No. 279, "Memorandum Opinion and Order", *Shure, Inc.* v. *ClearOne, Inc.* 1:17-cv-03078 (N.D. III—Eastern Division), Document No. 279, Mar. 16, 2018, 50.
Fed Cir Appeal 21-1024 Doc No. 43-2—43-4, "Joint Appendix vol. II", *Shure, Inc.* v. *ClearOne, Inc.*, 21-1024 (Fed. Cir. 2020), Document No. 43-2—43-4, Apr. 23, 2021, 467.
Fed Cir Appeal 21-1024 Doc No. 62, "ClearOne's Motion for Sanctions", *Shure, Inc.* v. *ClearOne, Inc.*, 21-1024 (Fed. Cir. 2020), Document No. 62, Jul. 16, 2021, 39.
Fed Cir Appeal 21-1024 Doc No. 63, "Opinion", *Shure, Inc.* v. *ClearOne, Inc.*, 21-1024 (Fed. Cir. 2020) (nonprecedential). Document No. 63, Jul. 20, 2021, 3.
Fed Cir Appeal 21-1024 Doc No. 67, "Plaintiff-Appellant's Reply Brief ", *Shure, Inc.* v. *ClearOne, Inc.*, 21-1024 (Fed. Cir. 2020), Document No. 67, Aug. 3, 2021, 32.
Fed Cir Appeal 21-1024 Doc No. 68, "ClearOne's Reply in Support of Motion for Sanctions", *Shure, Inc.* v. *ClearOne, Inc.*, 21-1024 (Fed. Cir. 2020), Document No. 68, Aug. 10, 2021, 85.
Fed Cir Appeal 21-1024 Doc No. 69, "Order Denying Motion for Sanctions", *Shure, Inc.* v. *ClearOne, Inc.*, 21-1024 (Fed Cir. 2020) (nonprecedential), Document No. 69, Aug. 24, 2021, 2.
IPR2019-00683 Doc No. 91, "Final Written Decision", *ClearOne, Inc.* v *Shure Acquisition Holdings, Inc.*, IPR2019-00683 (PTAB), Document No. 91, Aug. 14, 2020, 118.
Johnson, D. H. et al, "Array Signal Processing. Concepts and Techniques," p. 59, Prentice Hall (1993), 3.
McCowan, I.A., "Microphone Arrays: A Tutorial" excerpt from "Robust Speech Recognition using Microphone Arrays," PhD Thesis, Queensland University of Technology, Australia (2001), 40.
PGR2020-00079 Doc No. 35, "Preliminary Guidance Patent Owner's Motion to Amend", *Shure, Inc.* v. *ClearOne, Inc.*, PGR2020-00079 (P.T.A.B.), Document No. 35, Aug. 27, 2021, 19.
PGR2020-00079 Doc No. 37, "Patent Owner's Revised Motion to Amend", *Shure, Inc.* v. *ClearOne, Inc.*, PGR2020-00079 (P.T.A.B.), Document No. 37, Sep. 14, 2021, 38.
PGR2020-00079 Doc No. 39, "Patent Owner's Surreply", *Shure, Inc.* v. *ClearOne, Inc.*, PGR2020-00079 (P.T.A.B.), Document No. 39, Sep. 14, 2021, 33.
PGR2020-00079 Doc No. 42, "Petitioners Opposition to Patent Owners Revised Contingent Motion to Amend ", *Shure, Inc.* v. *ClearOne, Inc.*, PGR2020-00079 (P.T.A.B.), Document No. 42, Oct. 26, 2021, 29.
PGR2020-00079 Exhibit 1039, "Third Declaration of Dr Jeffrey S Vipperman", *Shure, Inc.* v. *ClearOne, Inc.*, PGR2020-00079 (P.T.A.B.), Exhibit 1039, Oct. 26, 2021, 46.
PGR2020-00079 Doc No. 49, "Reply to Petitioners Opposition to Patent Owners Revised Contingent Motion to Amend", *Shure, Inc.* v. *ClearOne, Inc.*, PGR2020-00079 (P.T.A.B.), Document No. 49, Nov. 16, 2021, 16.
PGR2020-00079 Exhibit 2038, "Third Declaration of Durand Begault in Support of the Reply to the Opposition to the Revised Motion to Amend", *Shure, Inc.* v. *ClearOne, Inc.*, PGR2020-00079 (P.T.A.B.), Exhibit 2038, Nov. 16, 2021, 27.
PGR2020-00079 Exhibit 2039, "Second Deposition of Jeffery Vipperman", *Shure, Inc.* v. *ClearOne, Inc.*, PGR2020-00079 (P.T.A.B.), Exhibit 2039, Nov. 16, 2021, 37.
PGR2020-00079 Exhibit 2042, "Selected Definitions from McGraw Hill Telecom Dictionary", *Shure, Inc.* v. *ClearOne, Inc.*, PGR2020-00079 (P.T.A.B.), Exhibit 2042, Nov. 16, 2021, 4.
PGR2020-00079 Exhibit 2044, "DCT 1:17-cv-03078 Doc. No. 367", *Shure, Inc.* v. *ClearOne, Inc.*, PGR2020-00079 (P.T.A.B.), Exhibit 2044, Nov. 16, 2021, 15.
PGR2020-00079 Exhibit 2045, "DCT 1:17-cv-03078 Doc. No. 367-1 Selected Pages", *Shure, Inc.* v. *ClearOne, Inc.*, PGR2020-00079 (P.T.A.B.), Exhibit 2045, Nov. 16, 2021, 8.
PGR2020-00079 Exhibit 2049, "Toroidal Microphones by Sessler, West, and Schroeder", *Shure, Inc.* v. *ClearOne, Inc.*, PGR2020-00079 (P.T.A.B.), Exhibit 2049, Nov. 16, 2021, 10.
PGR2020-00079 Exhibit 2050, "DCT 1:17-cv-03078 Doc. No. 360", *Shure, Inc.* v. *ClearOne, Inc.*, PGR2020-00079 (P.T.A.B.), Exhibit 2050, Nov. 16, 2021, 6.
PGR2020-00079 Exhibit 2178, "Federal Circuit Appeal 21-1517 Doc 14", *Shure, Inc.* v. *ClearOne, Inc.*, PGR2020-00079 (P.T.A.B.), Exhibit 2178, Nov. 16, 2021, 99.
PGR2020-00079 Exhibit 2179, "Federal Circuit Appeal 21-1517 Doc 18", *Shure, Inc.* v. *ClearOne, Inc.*, PGR2020-00079 (P.T.A.B.), Exhibit 2179, Nov. 16, 2021, 84.

(56) References Cited

OTHER PUBLICATIONS

PGR2020-00079 Exhibit 2180, "Federal Circuit Appeal 21-1517 Doc 22", *Shure, Inc*. v. *ClearOne, Inc.*, PGR2020-00079 (P.T.A.B.), Exhibit 2180, Nov. 16, 2021, 53.

* cited by examiner

BAND-LIMITED BEAMFORMING MICROPHONE ARRAY WITH ACOUSTIC ECHO CANCELLATION

CROSS REFERENCE TO RELATED APPLICATIONS

This application claims priority and the benefits of the earlier filed Provisional U.S. No. 61/771,751, filed Mar. 1, 2013, which is incorporated by reference for all purposes into this specification.

This application claims priority and the benefits of the earlier filed Provisional U.S. No. 61/828,524, filed May 29, 2013, which is incorporated by reference for all purposes into this specification.

This application is a continuation of U.S. Ser. No. 14/191,511, filed Feb. 27, 2014, which is incorporated by reference for all purposes into this specification.

And, this application is a continuation of U.S. Ser. No. 14/276,438, filed May 13, 2014, which is incorporated by reference for all purposes into this specification.

Further, this application is a continuation of U.S. Ser. No. 15/062,064, filed Mar. 5, 2016, which is incorporated by reference for all purposes into this specification.

TECHNICAL FIELD

This disclosure relates to beamforming microphone arrays, more specifically to a band-limited beamforming microphone array with acoustic echo cancellation.

BACKGROUND ART

Individual microphone elements designed for far field audio use can be characterized, in part, by their pickup pattern. The pickup pattern describes the ability of a microphone to reject noise and indirect reflected sound arriving at the microphone from undesired directions. The most popular microphone pickup pattern for use in audio conferencing applications is the cardioid pattern. Other patterns include supercardioid, hypercardioid, and bidirectional.

In a beamforming microphone array designed for far field use, a designer chooses the spacing between microphones to enable spatial sampling of a traveling acoustic wave. Signals from the array of microphones are combined using various algorithms to form a desired pickup pattern. If enough microphones are used in the array, the pickup pattern may yield improved attenuation of undesired signals that propagate from directions other than the "direction of look" of a particular beam in the array.

For use cases in which a beamformer is used for room audio conferencing, audio streaming, audio recording, and audio used with video conferencing products, it is desirable for the beamforming microphone array to capture audio containing frequency information that spans the full range of human hearing. This is generally accepted to be 20 Hz to 20 kHz.

Some beamforming microphone arrays are designed for "close talking" applications, like a mobile phone handset. In these applications, the microphone elements in the beamforming array are positioned within a few centimeters, to less than one meter, of the talker's mouth during active use. The main design objective of close talking microphone arrays is to maximize the quality of the speech signal picked up from the direction of the talker's mouth while attenuating sounds arriving from all other directions. Close talking microphone arrays are generally designed so that their pickup pattern is optimized for a single fixed direction.

Problems with the Prior Art

It is well known by those of ordinary skill in the art that the closest spacing between microphones restricts the highest frequency that can be resolved by the array and the largest spacing between microphones restricts the lowest frequency that can be resolved. At a given temperature and pressure in air, the relationship between the speed of sound, its frequency, and its wavelength is $c=\lambda v$ where c is the speed of sound, $\lambda$ is the wavelength of the sound, and v is the frequency of the sound.

For professionally installed conferencing applications, it is desirable for a microphone array to have the ability to capture and transmit audio throughout the full range of human hearing that is generally accepted to be 20 Hz to 20 kHz. The low frequency design requirement presents problems due to the physical relationship between the frequency of sound and its wavelength given by the simple equation in the previous paragraph. For example, at 20 degrees Celsius (68 degrees Fahrenheit) at sea level, the speed of sound in dry air is 340 meters per second. In order to perform beamforming down to 20 Hz, the elements of a beamforming microphone array would need to be 340/20=17 meters (55.8 feet) apart. A beamforming microphone this long would be difficult to manufacture, transport, install, and service. It would also not be practical in most conference rooms used in normal day-to-day business meetings in corporations around the globe.

The high frequency requirement for professional installed applications also presents a problem. Performing beamforming for full bandwidth audio may require significant computing resources including memory and CPU cycles, translating directly into greater cost.

It is also generally known to those of ordinary skill in the art that in most conference rooms, low frequency sound reverberates more than high frequency sound. One well-known acoustic property of a room is the time it takes the power of a sound impulse to be attenuated by 60 Decibels (dB) due to absorption of the sound pressure wave by materials and objects in the room. This property is called RT60 and is measured as an average across all frequencies. Rather than measuring the time it takes an impulsive sound to be attenuated, the attenuation time at individual frequencies can be measured. When this is done, it is observed that in most conference rooms, lower frequencies, (up to around 4 kHz) require a longer time to be attenuated by 60 dB as compared to higher frequencies (between around 4 kHz and 20 kHz).

SUMMARY OF INVENTION

This disclosure describes an apparatus and method of an embodiment of an invention that is a band-limited beamforming microphone array with acoustic echo cancellation. This embodiment of the apparatus/system includes: a plurality of first microphones configured as a beamforming microphone array to resolve first audio input signals within a first frequency range, the beamforming microphone array includes acoustic echo cancellation, the plurality of microphones of the beamforming microphone array are positioned at predetermined locations, the beamforming microphone array picks up audio input signals; one or more additional microphone(s) configured to resolve second audio input signals within a restricted second frequency range such that the additional microphone(s) are coupled to the beamforming microphone array; augmented beamforming that processes audio signals from the beamforming microphone array and the additional microphone(s) where the augmented beamforming further includes: receiving the resolved first audio signals from the beamforming microphone array, receiving the resolved and restricted second audio input signals, performing beamforming on the received and resolved first audio input signal, combining the beamformed first audio input signal with the resolved and restricted second audio input signals to create an audio signal within a band-limited frequency range.

The above embodiment of the invention may include one or more of these additional embodiments that may be combined in any and all combinations with the above embodiment. One embodiment of the invention describes that further comprises a microphone gating algorithm configured to apply attenuation to the resolved and restricted second audio input signal. One embodiment of the invention describes where the beamforming microphone array includes a last mic mode. One embodiment of the invention describes where the acoustic echo cancellation processing may occur in the beamforming microphone array or in a separate processing device. One embodiment of the invention describes where the beamforming microphone array includes a configurable pickup pattern for the beamforming. One embodiment of the invention describes where the beamforming microphone array includes adaptive steering technology. One embodiment of the invention describes where the beamforming microphone array includes adjustable noise cancellation. One embodiment of the invention describes where the beamforming microphone array includes adaptive acoustic processing that automatically adjusts to the room configuration for the best possible audio pickup.

The present disclosure further describes an apparatus and method of an embodiment of the invention as further described in this disclosure. Other and further aspects and features of the disclosure will be evident from reading the following detailed description of the embodiments, which should illustrate, not limit, the present disclosure.

BRIEF DESCRIPTION OF DRAWINGS

The drawings accompanying and forming part of this specification are included to depict certain aspects of the disclosure. A clearer impression of the disclosure, and of the components and operation of systems provided with the disclosure, will become more readily apparent by referring to the exemplary, and therefore non-limiting, embodiments illustrated in the drawings, where identical reference numerals designate the same components. Note that the features illustrated in the drawings are not necessarily drawn to scale. The following is a brief description of the accompanying drawings.

DISCLOSURE OF EMBODIMENTS

Figure 1A:
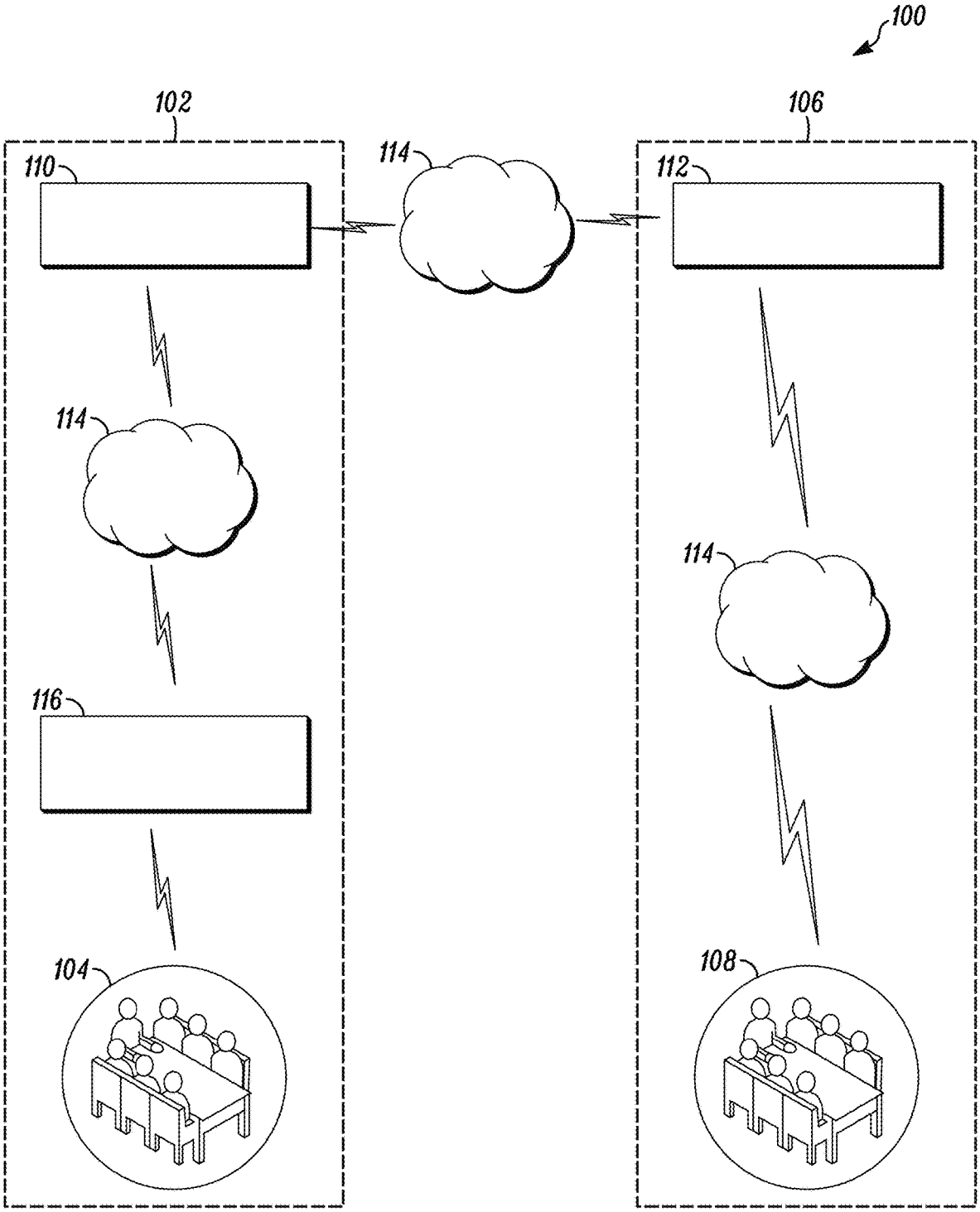
FIGS. 1A and 1B are illustrate environments for implementing embodiments of the present disclosure.

The disclosed embodiments should describe aspects of the disclosure in sufficient detail to enable a person of ordinary skill in the art to practice the invention. Other embodiments may be utilized, and changes may be made without departing from the disclosure. The following detailed description is not to be taken in a limiting sense, and the present invention is defined only by the included claims.

Specific implementations shown and described are only examples and should not be construed as the only way to implement or partition the present disclosure into functional elements unless specified otherwise in this disclosure. a person of ordinary skill in the art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

In the following description, elements, circuits, and functions may be shown in block diagram form in order not to obscure the present disclosure in unnecessary detail. And block definitions and partitioning of logic between various blocks are exemplary of a specific implementation. It will be readily apparent to a person of ordinary skill in the art that the present disclosure may be practiced by numerous other partitioning solutions. A person of ordinary skill in the art would understand that information and signals may be represented using any of a variety of technologies and techniques. For example, data, instructions, commands, information, signals, bits, symbols, and chips that may be referenced throughout the description may be represented by voltages, currents, electromagnetic waves, magnetic fields or particles, optical fields or particles, or any combination thereof. Some drawings may illustrate signals as a single signal for clarity of presentation and description. It will be understood by a person of ordinary skill in the art that the signal may represent a bus of signals, where the bus may have a variety of bit widths and the present disclosure may be implemented on any number of data signals including a single data signal.

The illustrative functional units include logical blocks, modules, and circuits described in the embodiments disclosed in this disclosure to more particularly emphasize their implementation independence. The functional units may be implemented or performed with a general purpose processor, a special purpose processor, a Digital Signal Processor (DSP), an Application Specific Integrated Circuit (ASIC), a Field Programmable Gate Array (FPGA) or other programmable logic device, discrete gate or transistor logic, discrete hardware components, or any combination thereof designed to perform the functions described in this disclosure. A general-purpose processor may be a microprocessor, any conventional processor, controller, microcontroller, or state machine. A general-purpose processor may be considered a special purpose processor while the general-purpose processor is configured to fetch and execute instructions (e.g., software code) stored on a computer-readable medium such as any type of memory, storage, and/or storage devices. A processor may also be implemented as a combination of computing devices, such as a combination of a DSP and a microprocessor, a plurality of microprocessors, one or more microprocessors in conjunction with a DSP core, or any other such configuration.

In addition, the illustrative functional units described above may include software or programs such as computer readable instructions that may be described in terms of a process that may be depicted as a flowchart, a flow diagram, a structure diagram, or a block diagram. The process may describe operational acts as a sequential process, many acts can be performed in another sequence, in parallel, or substantially concurrently. Further, the order of the acts may be rearranged. In addition, the software may comprise one or more objects, agents, threads, lines of code, subroutines, separate software applications, two or more lines of code or other suitable software structures operating in one or more software applications or on one or more processors. The software may be distributed over several code segments, modules, among different programs, and across several memory devices. Similarly, operational data may be identified and illustrated in this disclosure within modules and may be embodied in any suitable form and organized within any suitable data structure. The operational data may be collected as a single data set or may be distributed over different locations including over different storage devices.

Elements described in this disclosure may include multiple instances of the same element. These elements may be generically indicated by a numerical designator (e.g. 110) and specifically indicated by the numerical indicator followed by an alphabetic designator (e.g., 110A) or a numeric indicator preceded by a "dash" (e.g., 110-1). For ease of following the description, for the most part, element number indicators begin with the number of the drawing on which the elements are introduced or most discussed. For example, where feasible elements in FIG. 1 are designated with a format of 1*xx*, where 1 indicates FIG. 1 and xx designates the unique element.

It should be understood that any reference to an element in this disclosure using a designation such as "first," "second," and so forth does not limit the quantity or order of those elements, unless such limitation is explicitly stated. Rather, these designations may be used in this disclosure as a convenient method of distinguishing between two or more elements or instances of an element. A reference to a first and second element does not mean that only two elements may be employed or that the first element must precede the second element. In addition, unless stated otherwise, a set of elements may comprise one or more elements.

Reference throughout this specification to "one embodiment", "an embodiment" or similar language means that a particular feature, structure, or characteristic described in the embodiment is included in at least one embodiment of the present invention. Appearances of the phrases "one embodiment", "an embodiment" and similar language throughout this specification may, but do not necessarily, all refer to the same embodiment.

In the following detailed description, reference is made to the illustrations, which form a part of the present disclosure, and in which is shown, by way of illustration, specific embodiments in which the present disclosure may be practiced. These embodiments are described in sufficient detail to enable a person of ordinary skill in the art to practice the present disclosure. However, other embodiments may be utilized, and structural, logical, and electrical changes may be made without departing from the true scope of the present disclosure. The illustrations in this disclosure are not meant to be actual views of any particular device or system but are merely idealized representations employed to describe embodiments of the present disclosure. And the illustrations presented are not necessarily drawn to scale. And, elements common between drawings may retain the same or have similar numerical designations.

It will also be appreciated that one or more of the elements depicted in the drawings/figures can also be implemented in a more separated or integrated manner, or even removed or rendered as inoperable in certain cases, as is useful in accordance with a particular application. Additionally, any signal arrows in the drawings/figures should be considered only as exemplary, and not limiting, unless otherwise specifically noted. The scope of the present disclosure should be determined by the following claims and their legal equivalents.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus. Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

To aid any Patent Office and any readers of any patent issued on this disclosure in interpreting the included claims, the Applicant(s) wish to note that they do not intend any of the appended claims or claim elements to invoke 35 U.S.C. 112(f) unless the words "means for" or "step for" are explicitly used in the particular claim.

A "something" and an "another something" may be used interchangeably in this specification.

Non-Limiting Definitions

In various embodiments of the present disclosure, definitions of one or more terms that will be used in the document are provided below.

A "beamforming microphone array" is used in the present disclosure in the context of its broadest definition. The beamforming microphone array is a collection of microphones coupled together and positioned in predefined locations that picks up audio from a wide field of view. The microphones are electrically connected to analog to digital converters, which in turn send their digital representations of the microphone signals to a processor. The processor executes an algorithm that performs beamforming to create a directional pickup pattern. An algorithm combines the microphone signals and sends out a single signal representing the beamformed output for each beam that is created.

A "beamforming microphone" is used in the present disclosure in the context of its broadest definition. The beamforming microphone is a microphone used in a beamforming microphone array whose output is used by the beamforming algorithm, along with the other beamforming microphones in the array, to generate a directional pickup pattern through the use of the algorithm.

A "non-beamforming microphone" is used in the present disclosure in the context of its broadest definition. The non-beamforming microphone may refer to a microphone configured to resolve audio input signals over a broad frequency range received from multiple directions. Examples of non-beamforming microphones can include standard cardioid microphones such as typically found in conference rooms. A non-beamforming microphone is a microphone that produces an output that is not used by the beamforming algorithm to produce a directional pickup pattern.

The numerous references in the disclosure to a band-limited beamforming microphone array are intended to cover any and/or all devices capable of performing respective operations in the applicable context, regardless of whether or not the same are specifically provided.

Figure 1B:
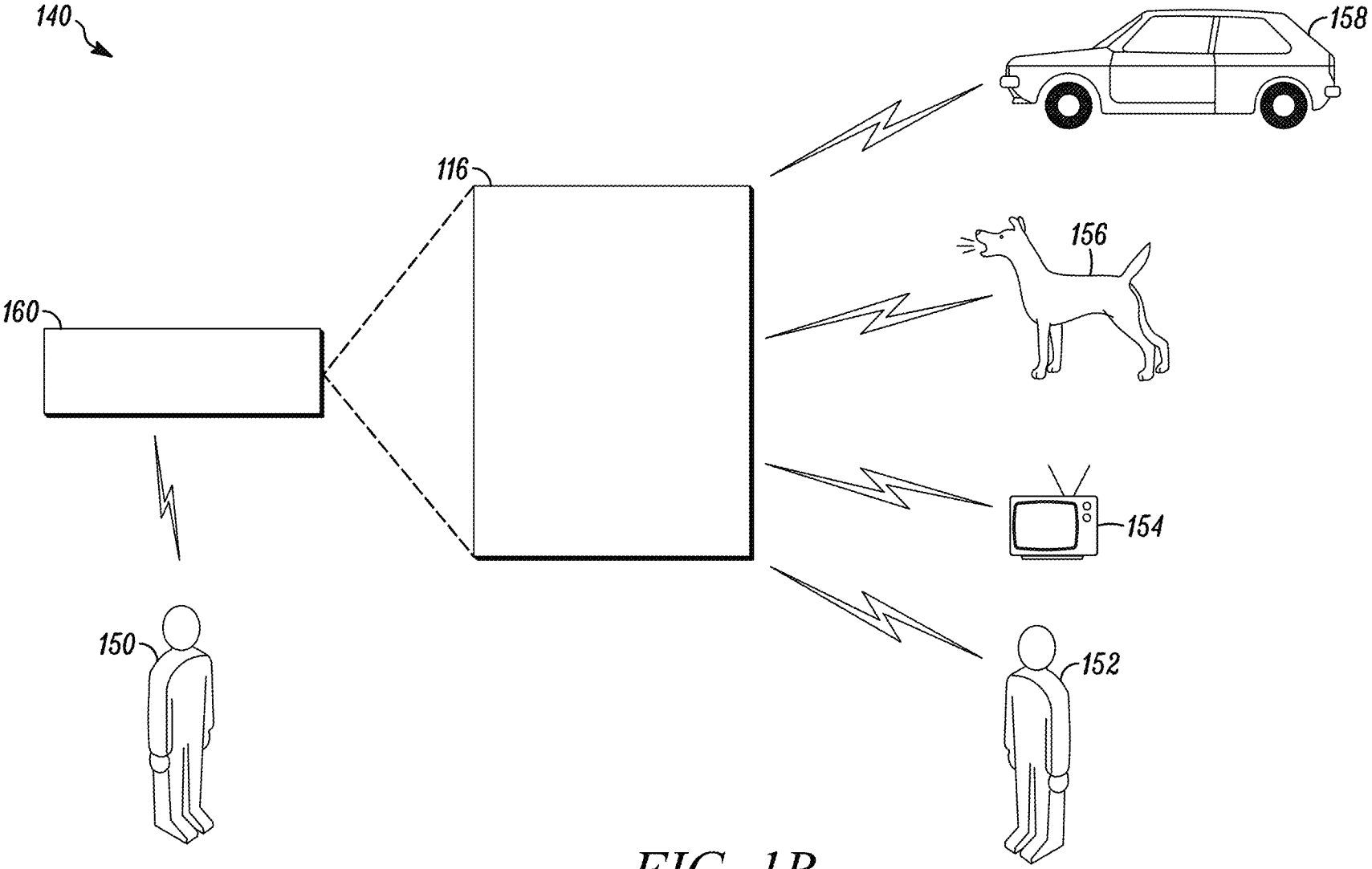

FIGS. 1A and 1B illustrate environments for a band-limited beamforming microphone array by augmenting a beamforming microphone array with non-beamforming microphones. FIG. 1 illustrates a first environment 100 (e.g., audio conferencing, video conferencing, etc.) that involves interaction between multiple users located within one or more substantially enclosed areas, e.g., a room. The first environment 100 may include a first location 102 having a first set of users 104 and a second location 106 having a second set of users 108. The first set of users 104 may communicate with the second set of users 108 using a first communication device 110 and a second communication device 112 respectively over a network 114. The first communication device 110 and the second communication device 112 may be implemented as any of a variety of computing devices (e.g., a server, a desktop PC, a notebook, a workstation, a personal digital assistant (PDA), a mainframe computer, a mobile computing device, an internet appliance, etc.) and calling devices (e.g., a telephone, an internet phone, etc.). The first communication device 110 may be compatible with the second communication device 112 to exchange audio input signals with each other or any other compatible devices.

The disclosed embodiments may involve transfer of data, e.g., audio data, over the network 114. The network 114 may include, for example, one or more of the following: the Internet, Wide Area Networks (WANs), Local Area Networks (LANs), analog or digital wired and wireless telephone networks (e.g., a PSTN, Integrated Services Digital Network (ISDN), a cellular network, and Digital Subscriber Line (xDSL)), radio, television, cable, satellite, and/or any other delivery or tunneling mechanism for carrying data. Network 114 may include multiple networks or sub-networks, each of which may include, for example, a wired or wireless data pathway. The network 114 may include a circuit-switched voice network, a packet-switched data network, or any other network able to carry electronic communications. For example, the network 114 may include networks based on the Internet protocol (IP) or asynchronous transfer mode (ATM), and may support voice using, for example, VoIP, Voice-over-ATM, or other comparable protocols used for voice data communications. Other embodiments may involve the network 114 including a cellular telephone network configured to enable exchange of text or multimedia messages.

The first environment may also include a band-limited beamforming microphone array 116 (hereinafter referred to as band-limited array 116) interfacing between the first set of users 104 and the first communication device 110 over the network 114. The band-limited array 116 may include multiple microphones for converting ambient sounds (such as voices or other sounds) from various sound sources (such as the first set of users 104) at the first location 102 into audio input signals. In an embodiment, the band-limited array 116 may include a combination of beamforming microphones in a beamforming microphone array (BFMs) and non-beamforming microphones (NBMs). The BFMs may be configured to capture the audio input signals (BFM signals) within a first frequency range, and the NBMs (NBM signals) may be configured to capture the audio input signals within a second frequency range.

The non-beamforming microphones do not perform beamforming when operating in the non-beamforming mode. The main beamformer output signal has a bandpass frequency response. Listeners may complain that it lacks low-end and high-end frequency response. One non-beamforming microphone may be added to help supplement the low-end response of the beamformer. Another non-beamforming microphone may be added to supplement the high-end response. Some sort of noise reduction processing may need to be included to maintain a high signal to noise ratio after the non-beamforming microphones are added.

The band-limited array 116 may transmit the captured audio input signals to the first communication device 110 for processing and transmit the processed captured audio input signals to the second communication device 112. In an embodiment, the first communication device 110 may be configured to perform augmented beamforming within an intended bandpass frequency window using a combination of BFMs and one or more NBMs. For this, the first communication device 110 may be configured to combine band-limited NBM signals to the BFM signals within the bandpass frequency window, discussed later in greater detail, by applying one or more of various beamforming algorithms, such as, delay and sum algorithm, filter sum algorithm, etc. known in the art, related art or developed later. The bandpass frequency window may be a combination of the first frequency range corresponding to the BFMs and the band-limited second frequency range corresponding to the NBMs.

Embodiments of the array 116 can include audio acoustic characteristics that include: auto voice tracking, adjustable noise cancellation, beamforming and adaptive steering technology, acoustic echo cancellation (AEC), mono and stereo, adaptive acoustic processing that automatically adjusts to room configurations for the best possible audio pickup, and replaces traditional microphones with expanded pick-up range. Embodiments of the array 116 can include auto mixer parameters that include: Number of Open Microphones (NOM), First mic priority mode, Last mic mode, Maximum number of mics mode Ambient level, Gate threshold adjust Off attenuation adjust Hold time, and Decay rate. Embodiments of the array 116 can include beamforming microphone array configurations that include: Echo cancellation on/off, Noise cancellation on/off, Filters: (All Pass, Low Pass, High Pass, Notch, PEQ), ALC on/off, Gain adjust, Mute on/off, Auto gate/manual gate. One skilled in the art will understand that the AEC processing may occur in the same first device that includes the beamforming microphones, or it may occur in a separate device, such as a special AEC processing device or general processing device, that is in communication with the first device. Additionally, another embodiment of Array 116 may include a configurable pickup pattern for the beamforming. In addition, another embodiment of Array 116 may include a microphone array that includes 24 microphone elements.

Unlike conventional beamforming microphone arrays, the band-limited array 116 has better frequency response due to augmented beamforming of the audio input signals within the bandpass frequency window. The inclusion of non-beamforming microphones to the array allows us to apply a bandpass filter to the output of the beamformed microphones to ensure that it does not pick up noise from frequencies outside the frequency range in which beamforming is performed. In one embodiment, the first communication device 110 may configure the desired bandpass frequency range to the human hearing frequency range (i.e., 20 Hz to 20 KHz); however, one of ordinary skill in the art may predefine the bandpass frequency window based on an intended application. In some embodiments, the band-limited array 116 in association with the first communication device 110 may be additionally configured with adaptive steering technology known in the art, related art, or developed later for better signal gain in a specific direction towards an intended sound source, e.g., at least one of the first set of users 104.

The first communication device 110 may transmit one or more augmented beamforming signals within the bandpass frequency window to the second set of users 108 at the second location 106 via the second communication device 112 over the network 114. In some embodiments, the band-limited array 116 may be integrated with the first communication device 110 to form a band-limited communication system.

FIG. 1B illustrates another environment 140 (e.g., public surveillance, song recording, etc.) that may involve interaction between a user and multiple entities located at open surroundings, like a playground. The second environment 140 may include a user 150 receiving sounds from various sound sources, such as, a second person 152 or a group of persons, a television 154, an animal such as a dog 156, transportation vehicles such as a car 158, etc., present in the open surroundings via an audio reception device 160. The audio reception device 160 may be in communication with, or include, the band-limited array 116 configured to perform beamforming on audio input signals based on the sounds received from various entities behaving as sound sources, such as those mentioned above, within the predefined bandpass frequency window. The audio reception device 160 may be a wearable device which may include, but are not limited to, a hearing aid, a hand-held baton, a body clothing, eyeglass frames, etc., which may be generating the augmented beamforming signals within the bandpass frequency window, such as the human hearing frequency range.

Figure 2:
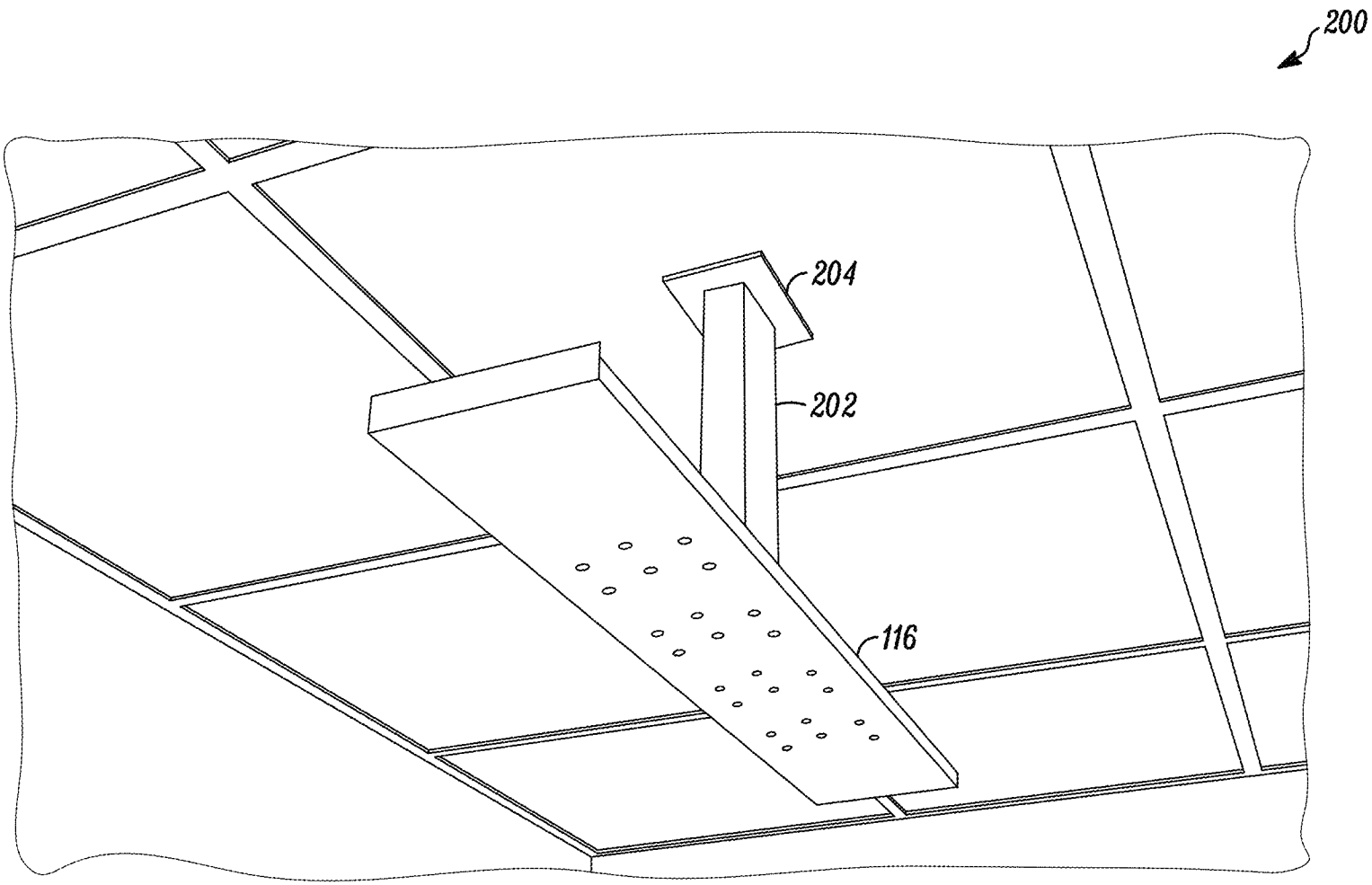
FIG. 2 is a perspective view of an embodiment of the present disclosure.

FIG. 2 is a perspective view 200 of the band-limited beamforming microphone array of FIG. 1, according to an embodiment of the present disclosure. The band-limited array 116 may be configured and arranged into various usage configurations, such as drop-ceiling mounting, wall mounting, table mounting, etc. As shown, the band-limited array 116 may be configured and arranged to a ceiling mounted configuration, in which the band-limited array 116 may be associated with a spanner post 202 inserted into a ceiling mounting plate 204 configured to be in contact with a ceiling 206. In general, the band-limited array 116 may be suspended from the ceiling 206, such that the audio input signals are received by one or more microphones in the band-limited array 116 from above an audio source, such as one of the first set of users 104. The band-limited array 116, the spanner post 202, and the ceiling mounting plate 204 may be appropriately assembled together using various fasteners such as screws, rivets, etc. known in the art, related art, or developed later. The band-limited array 116 may be associated with additional mounting and installation tools and parts including, but not limited to, position clamps, support rails (for sliding the band-limited array 116 in a particular axis), array mounting plate, etc. that are well known in the art and may be understood by a person skilled in the art; and hence, these tools and parts are not discussed in detail herein.

Figure 3:
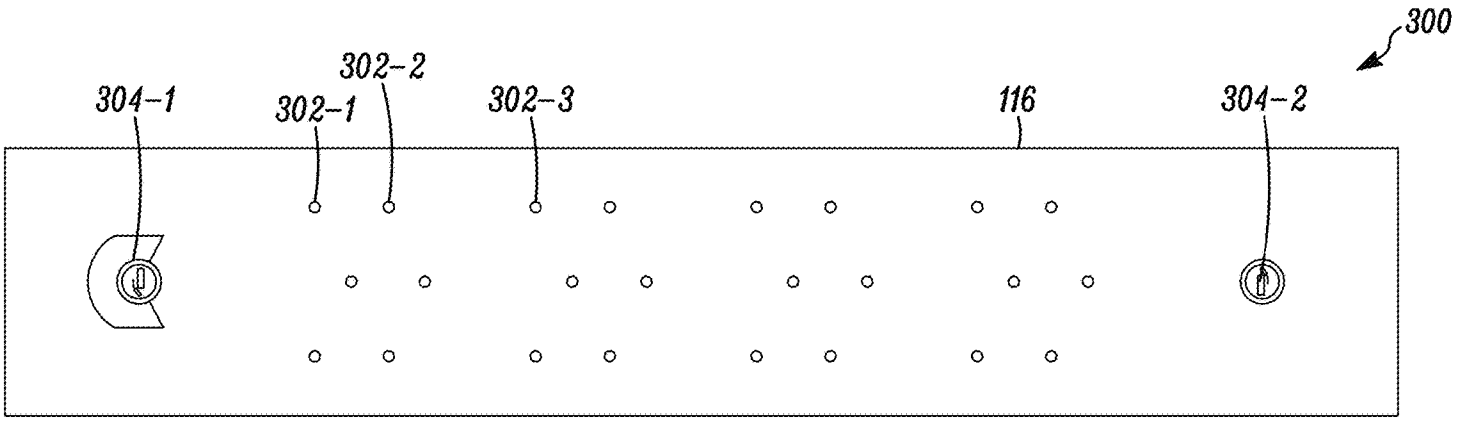
FIG. 3 is a schematic view that illustrates a front side an embodiment of the present disclosure.

FIG. 3 is a schematic view that illustrates a first side 300 of the exemplary band-limited beamforming microphone array of FIG. 1, according to an embodiment of the present disclosure. At the first side 300, the band-limited array 116 may include multiple BFMs and NBMs (not shown). The BFMs 302-1, 302-2, 302-3, **302-*n* (collectively, BFMs 302) may be arranged in a specific pattern that facilitates maximum directional coverage of various sound sources in the ambient surrounding. In an embodiment, the band-limited array 116 may include twenty-four BFMs 302 operating in a frequency range 150 Hz to 16 KHz. Multiple BFMs 302 offer narrow beamwidth of a main lobe on a polar plot in the direction of a particular sound source and improve directionality or gain in that direction. The spacing between each pair of the BFMs 302 may be less than half of the wavelength of sound intended to be received from a particular direction. Above this spacing, the directionality of the BFMs 302 may be reduced and large side lobes begin to appear in the energy pattern on the polar plot in the direction of the sound source. The side lobes indicate alternative directions from where the BFMs 302 may pick-up noise, thereby reducing the directionality of the BFMs 302** in the direction of the sound source.

The BFMs 302 may be configured to convert the received sounds into audio input signals within the operating frequency range of the BFMs 302. Beamforming may be used to point the BFMs 302 at a particular sound source to reduce interference and improve quality of the received audio input signals. The band-limited array 116 may optionally include a user interface having various elements (e.g., joystick, button pad, group of keyboard arrow keys, a digitizer screen, a touchscreen, and/or similar or equivalent controls) configured to control the operation of the band-limited array 116 based on a user input. In some embodiments, the user interface may include buttons 304-1 and 304-2 (collectively, buttons 304), which upon being activated manually or wirelessly may adjust the operation of the BFMs 302 and the NBMs. For example, the buttons 304-1 and 304-2 may be pressed manually to mute the BFMs 302 and the NBMs, respectively. The elements such as the buttons 304 may be represented in different shapes or sizes and may be placed at an accessible place on the band-limited array 116. As shown, the buttons 304 may be circular in shape and positioned at opposite ends of the linear band-limited array 116 on the first side 300.

Some embodiments of the user interface may include different numeric indicators, alphanumeric indicators, or non-alphanumeric indicators, such as different colors, different color luminance, different patterns, different textures, different graphical objects, etc. to indicate different aspects of the band-limited array 116. In one embodiment, the buttons 304-1 and 304-2 may be colored red to indicate that the respective BFMs 302 and the NBMs are muted.

Figure 4A:
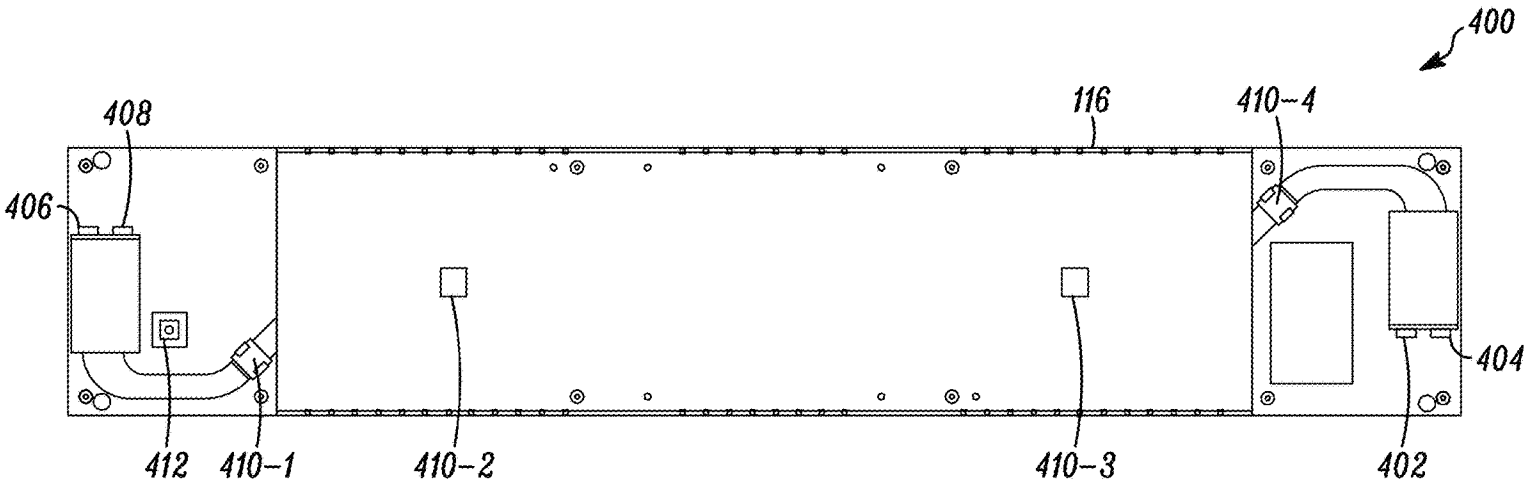
FIG. 4A is a schematic view that illustrates a back side of an embodiment of the present disclosure.
Figure 4B:
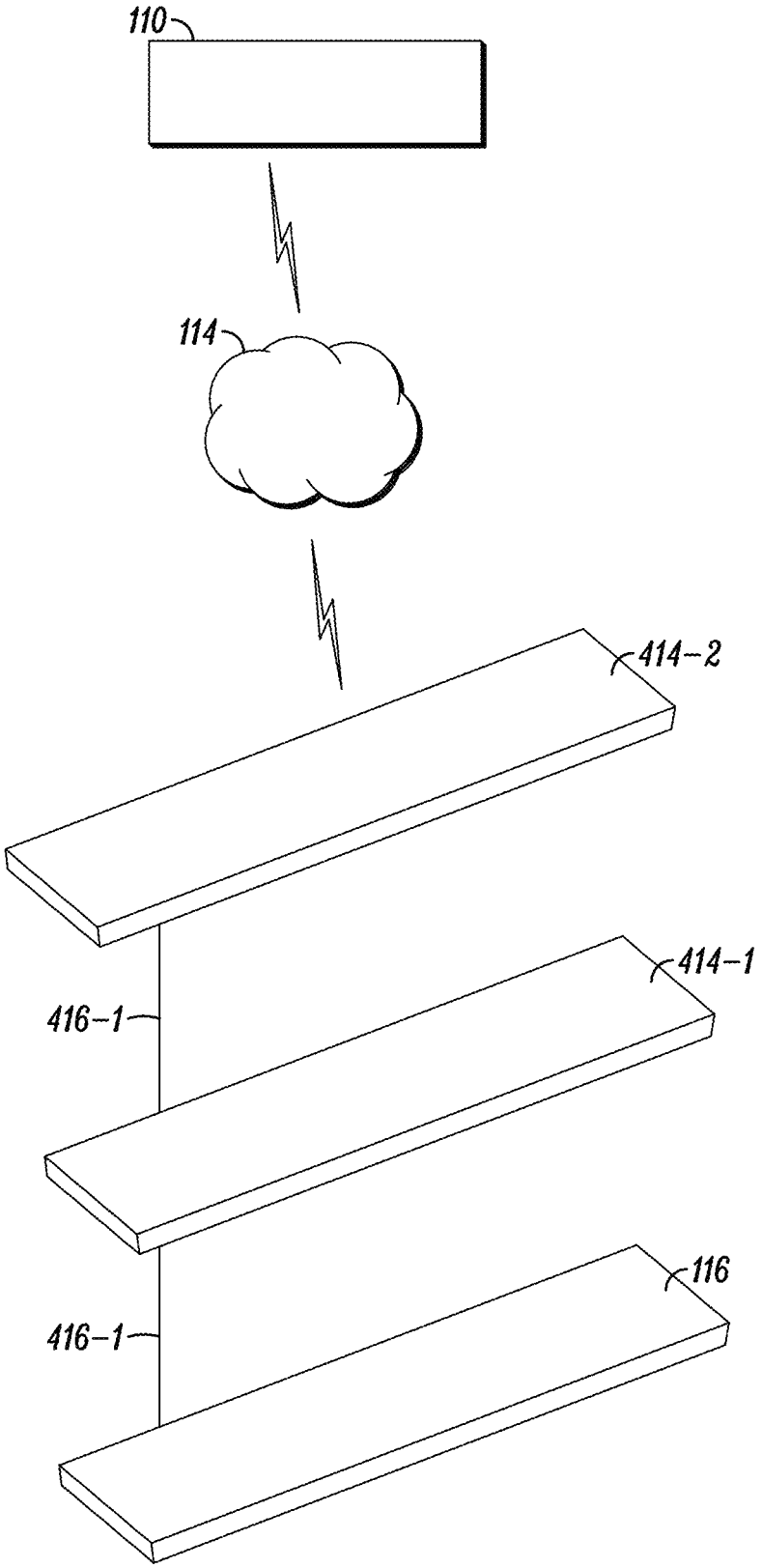
FIG. 4B is a schematic view that illustrates multiple beamforming microphone arrays connected to each other.

FIG. 4 is a schematic view that illustrates a second side 400 of the exemplary band-limited beamforming microphone array of FIG. 1, according to an embodiment of the present disclosure. At the second side 400, the band-limited array 116 may include a link-in bus (E-bus) connection 402, a link-out E-bus connection 404, a USB input support port 406, a power-over-Ethernet (PoE) connector 408, retention clips 410-1, 410-2, 410-3, 410-4 (collectively, retention clips 410), and a device selector 412. In one embodiment, the band-limited array 116 may be connected to the first communication device 110 through a suitable Expansion-bus (or E-bus) cable, such as CAT5-24AWG solid conductor RJ45 cable, via the link-in E-bus connection 402. The link-out E-bus connection 404 may be used to connect the band-limited array 116 using the E-bus to another band-limited array. The E-bus may be connected to the link-out E-bus connection 404 of the band-limited array 116 and the link-in E-bus connection 402 of that another band-limited array 116. In a similar manner, multiple band-limited array's may be connected together using multiple E-buses for connecting each pair of the band-limited arrays. In an exemplary embodiment, as shown in FIG. 4B, the band-limited array 116 may be connected to a first auxiliary band-limited array 414-1 (first auxiliary array 414-1) and a second auxiliary band-limited array 414-2 (second auxiliary array 414-1) in a daisy chain arrangement. The band-limited array 116 may be connected to the first auxiliary array 414-1 using a first E-bus 416-1, and the first auxiliary array 414-1 may be connected to the second auxiliary array 414-2 using a second E-bus 416-2. The number of band-limited arrays being connected to each other (such as, to perform an intended operation with desired performance) may depend on processing capability and compatibility of a communication device, such as the first communication device 110, associated with at least one of the connected band-limited arrays.

Further, the first communication device 110 may be updated with appropriate firmware to configure the multiple band-limited arrays connected to each other or each of the band-limited arrays being separately connected to the first communication device 110. The USB input support port 406 may be configured to receive audio input signals from any compatible device using a suitable USB cable.

The band-limited array 116 may be powered through a standard PoE switch or through an external PoE power supply. An appropriate AC cord may be used to connect the PoE power supply to the AC power. The PoE cable may be plugged into the LAN+DC connection on the power supply and connected to the PoE connector 408 on the band-limited array 116. After the PoE cables and the E-bus(s) are plugged to the band-limited array 116, they may be secured under the cable retention clips 410.

The device selector 412 may be configured to introduce a communicating band-limited array, such as the band-limited array 116, to the first communication device 110. For example, the device selector 412 may assign a unique identity (ID) to each of the communicating band-limited arrays, such that the ID may be used by the first communication device 110 to interact or control the corresponding band-limited array. The device selector 412 may be modeled in various formats. Examples of these formats include, but are not limited to, an interactive user interface, a rotary switch, etc. In some embodiments, each assigned ID may be represented as any of the indicators such as those mentioned above for communicating to the first communication device or for displaying at the band-limited arrays. For example, each ID may be represented as hexadecimal numbers ranging from '0' to 'F'.

Figure 5:
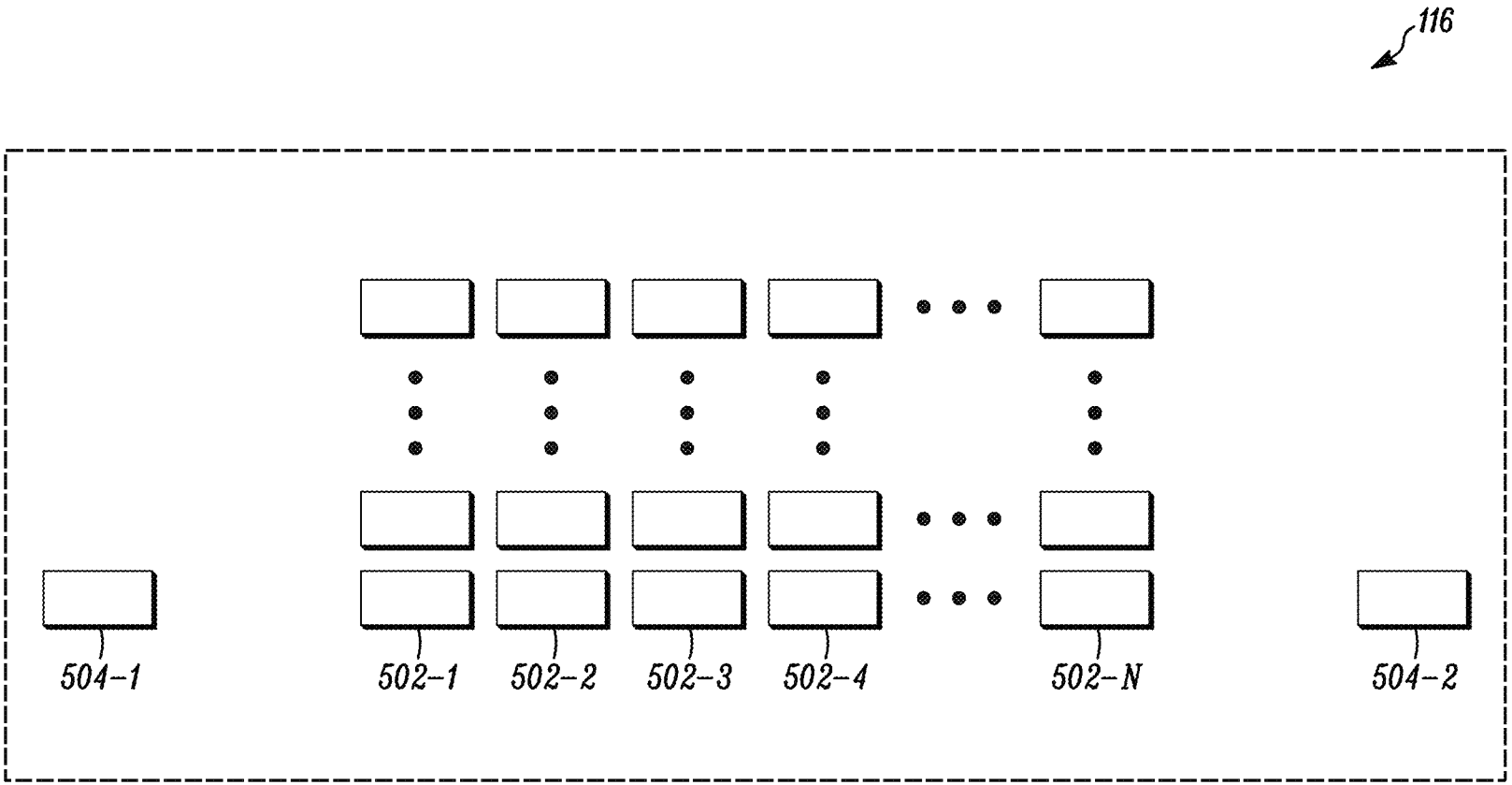
FIG. 5 is a schematic view that illustrates an arrangement of microphones in a beamforming microphone array.

FIG. 5 is a schematic that illustrates arrangement of microphones in the band-limited beamforming array of FIG. 1, according to an embodiment of the present disclosure. The band-limited array 116 may include a number of microphones including multiple BFMs such as 502-1, 502-2, 502-3, 502-4, **502-*n* (collectively, BFMs 502) and the NBMs 504-1 and 504-2 (collectively, NBMs 504). Each of the microphones such as the BFMs 502 and the NBMs 504 may be arranged in a predetermined pattern that facilitates maximum coverage of various sound sources in the ambient surrounding. In one embodiment, the BFMs 502 and the NBMs 504 may be arranged in a linear fashion, such that the BFMs 502 have maximum directional coverage of the surrounding sound sources. However, one of ordinary skill in the art would understand that the NBMs 504 may be arranged in various alignments with respect to the BFMs 502 based on at least one of acoustics of the ambient surrounding, such as in a room, and the desired pick-up pattern of the NBMs 504**.

Each of the microphones 502, 504 may be arranged to receive sounds from various sound sources located at a far field region and configured to convert the received sounds into audio input signals. The BFMs 502 may be configured to resolve the audio input signals within a first frequency range based on a predetermined separation between each pair of the BFMs 502. On the other hand, the NBMs 508 may be configured to resolve the audio input signals within a second frequency range. The lowest frequency of the first frequency range may be greater than the lowest frequency of the second frequency range. Both the BFMs 502 and the NBMs 502 may be configured to operate within a low frequency range. In one embodiment, the first frequency range corresponding to the BFMs 502 may be 150 Hz to 16 KHz, and the second frequency range corresponding to the NBMs 504 may be 16 Hz to 20 KHz. However, the pick-up pattern of the BFMs 502 may differ from that of the NBMs 504 due to their respective unidirectional and omnidirectional behaviors.

The BFMs 502 may be implemented as any one of the analog and digital microphones such as carbon microphones, fiber optic microphones, dynamic microphones, electret microphones, MEMS microphones, etc. In some embodiments, the band-limited array 116 may include at least two BFMs, though the number of BFMs may be further increased to improve the strength of desired signal in the received audio input signals. The NBMs 504 may also be implemented as a variety of microphones such as those mentioned above. In one embodiment, the NBMs 504 may be cardioid microphones placed at opposite ends of a linear arrangement of the BFMs 506 and may be oriented so that they are pointing outwards. The cardioid microphone has the highest sensitivity and directionality in the forward direction, thereby reducing unwanted background noise from being picked-up within its operating frequency range, for example, the second frequency range. Although the shown embodiment includes two NBMs 504, one with ordinary skill in the art may understand that the band-limited array 116 may be implemented using only one non-beamforming microphone.

Figure 6:
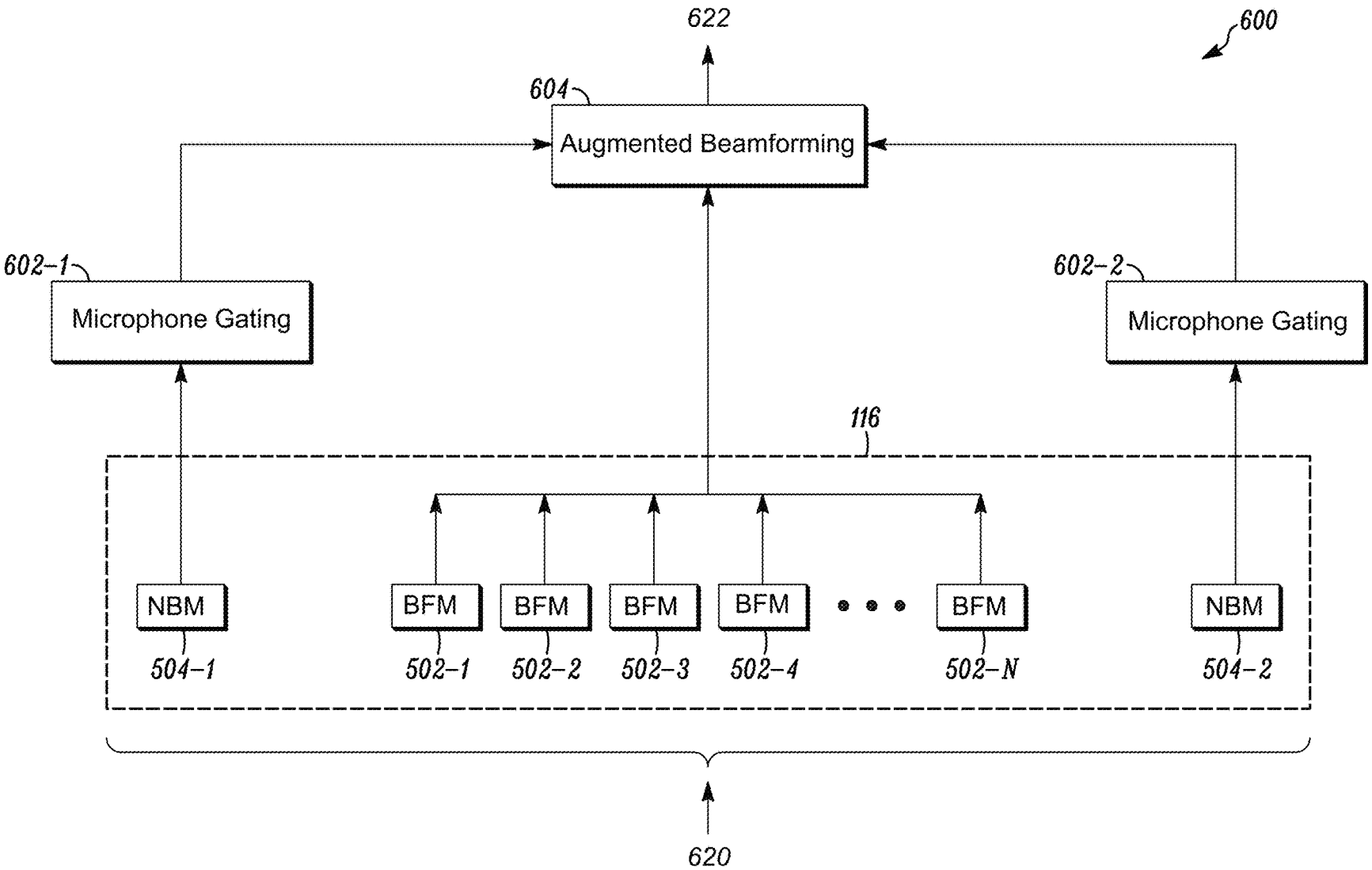
FIG. 6 is a schematic view that illustrates a system for implementing a beamforming microphone array.

FIG. 6 is a schematic that illustrates a system 600 for implementing an embodiment of a beamforming microphone array according to the present disclosure. The system 600 has input signal 620 and output signal 622 and includes the band-limited array 116, microphone gating algorithm blocks 602-1, 602-2 (collectively, microphone gating algorithm blocks 602), and the augmented beamforming block 604. The microphone gating algorithm blocks use a microphone gating algorithm that is designed to apply attenuation to the microphone that is not pointing in the direction of the local talker. The use of microphone gating reduces undesired audio artifacts such as excessive noise and reverberation. The band-limited array 116 may include multiple BFMs such as the BFMs 502 and the NBMs 504 arranged in a linear fashion as discussed in the description of FIG. 5. The BFMs 502 and the NBMs 504 may be configured to convert the received sounds into audio input signals.

The microphone gating algorithm blocks 602 may be configured to apply attenuation to the audio input signals from at least one of the NBMs 504, such as the NBM 504-1, whose directionality, i.e., gain, towards a desired sound source is relatively lesser than that of the other, such as the NBM 504-2, within the human hearing frequency range (i.e., 20 Hz to 20 KHz). In an embodiment, the microphone gating algorithm blocks 602 may be configured to restrict the second frequency range corresponding to the non-beamforming microphone (having lesser directionality towards a particular sound source) based on one or more threshold values. Such restricting of the second frequency range may facilitate (1) extracting the audio input signals within the human hearing frequency range, and (2) controlling the amount of each of the non-beamforming signal applied to the augmented beamforming block 504, using any one of various microphone gating techniques known in the art, related art, or later developed.

Each of the one or more threshold values may be predetermined based on the intended bandpass frequency window, such as the human hearing frequency range, to perform beamforming. In one embodiment, at least one of the predetermined threshold values may be the lowest frequency or the highest frequency of the first frequency range at which the BFMs 502 are configured to operate. In one embodiment, if the threshold value is the lowest frequency (i.e., 20 Hz) of the first frequency range, the microphone gating algorithm blocks 602 may be configured to restrict the second frequency range between 20 Hz and 150 Hz. In another embodiment, if the threshold value is the highest frequency (i.e., 16 KHz) of the first frequency range, the microphone gating algorithm blocks 602 may be configured to limit the second frequency range between 16 KHz and 20 KHz.

In another embodiment, the microphone gating algorithm blocks 602 may be configured to restrict the second frequency range based on a first threshold value and a second threshold value. For example, if the first threshold value is the highest frequency (i.e., 16 KHz) of the first frequency range and the second threshold value is the highest frequency (i.e., 20 KHz) of the human hearing frequency range, the microphone gating algorithm blocks 602 may restrict the second frequency range between 16 KHz to 20 KHz. Accordingly, the microphone gating algorithm blocks 602 may output the audio input signals within the restricted second frequency range (hereinafter referred to as restricted audio input signals). One skilled in the art will appreciate that these blocks are performing a filtering function in addition to a gating function.

The augmented beamforming block 604 may be configured to perform beamforming on the received audio input signals within a predetermined bandpass frequency range or window. In an embodiment, the augmented beamforming block 604 may be configured to perform beamforming on the received audio input signals from the BFMs 502 within the human hearing frequency range using the restricted audio input signals from the microphone gating algorithm blocks 602.

The audio input signals from the BFMs 502 and the NBMs 504 may reach the augmented beamforming block 604 at a different temporal instance as the NBMs 504 as they only provide low frequency coverage. As a result, the audio input signals from the NBMs 504 may be out of phase with respect to the audio input signals from BFMs 502. The augmented beamforming block 604 may be configured to control amplitude and phase of the received audio input signals within an augmented frequency range to perform beamforming. The augmented frequency range refers to the bandpass frequency range that is a combination of the operating first frequency range of the BFMs 502 and the restricted second frequency range generated by the microphone gating algorithm blocks 602.

The augmented beamforming block 604 may adjust side lobe audio levels and steering of the BFMs 502 by assigning complex weights or constants to the audio input signals within the augmented frequency range received from each of the BFMs 502. The complex constants may shift the phase and set the amplitude of the audio input signals within the augmented frequency range to perform beamforming using various beamforming techniques such as those mentioned above. Accordingly, the augmented beamforming block 604 may generate an augmented beamforming signal within the bandpass frequency range. In some embodiments, the augmented beamforming block 604 may generate multiple augmented beamforming signals based on combination of the restricted audio input signals and the audio input signals from various permutations of the BFMs 502.

This present disclosure enables the full range of human hearing to be captured and transmitted by the combined set of BFMs 502 and NBMs 504 while minimizing the physical size of the band-limited array 116, and simultaneously allowing the cost to be reduced as compared to existing beamforming array designs and approaches that perform beamforming throughout the entire frequency range of human hearing.

While the present disclosure has been described in this disclosure regarding certain illustrated and described embodiments, those of ordinary skill in the art will recognize and appreciate that the present disclosure is not so limited. Rather, many additions, deletions, and modifications to the illustrated and described embodiments may be made without departing from the true scope of the invention, its spirit, or its essential characteristics as claimed along with their legal equivalents. In addition, features from one embodiment may be combined with features of another embodiment while still being encompassed within the scope of the invention as contemplated by the inventor. The described embodiments are to be considered only as illustrative and not restrictive. All changes which come within the meaning and range of equivalency of the claims are to be embraced within their scope. Disclosing the present invention is exemplary only, with the true scope of the present invention being determined by the included claims.

The invention claimed is:

1. A band-limited microphone array with beamforming and acoustic echo cancellation, comprising:

a first plurality of microphones configured as a microphone array and used for beamforming processing to resolve first audio input signals within a first frequency range, the microphone array further includes acoustic echo cancellation, the first plurality of microphones of the microphone array are positioned at predetermined locations, the microphone array picks up audio input signals;

one or more additional non-beamforming microphone(s) configured to resolve second audio input signals within a restricted second frequency range such that the additional non-beamforming microphone(s) are coupled to the microphone array;

augmented beamforming that processes audio signals from the microphone array and the additional non-beamforming microphone(s) where the augmented beamforming further includes: receiving the resolved first audio signals from the microphone array, receiving the resolved and restricted second audio input signals, performing beamforming on the received and resolved first audio input signal, combining the beamformed first audio input signal with the resolved and restricted second audio input signals to create an audio signal within a band-limited frequency range.

2. The claim according to claim 1 that further comprises a microphone gating algorithm configured to apply attenuation to the resolved and restricted second audio input signal.

3. The claim according to claim 1 where the microphone array further includes a last mic mode.

4. The claim according to claim 1 where the microphone array further includes a configurable pickup pattern for the beamforming.

5. The claim according to claim 1 where the microphone array further includes adaptive steering technology.

6. The claim according to claim 1 where the microphone array further includes adjustable noise cancellation.

7. The claim according to claim 1 where the microphone array further includes adaptive acoustic processing that automatically adjusts to the room configuration for audio pickup.

8. A method to manufacture a band-limited microphone array with beamforming and acoustic echo cancellation, comprising:

providing a plurality of first microphones as a microphone array used for beamforming processing to resolve first audio input signals within a first frequency range, the microphone array further includes acoustic echo cancellation, the plurality of microphones of the microphone array are positioned at predetermined locations, the microphone array picks up audio input signals;

coupling one or more additional non-beamforming microphone(s) to the microphone array such that the additional non-beamforming microphone(s) are configured to resolve second audio input signals within a restricted second frequency range;

providing augmented beamforming that processes audio signals from the microphone array and the additional non-beamforming microphone(s) where the augmented beamforming further includes: receiving the resolved first audio signals from the microphone array, receiving the resolved and restricted second audio input signals, performing beamforming on the received and resolved first audio input signal, combining the beamformed first audio input signal with the resolved and restricted second audio input signals to create an audio signal within a band-limited frequency range.

9. The claim according to claim 8, that further comprises a microphone gating algorithm configured to apply attenuation to the resolved and restricted second audio input signal.

10. The claim according to claim 8 where the microphone array further includes a last mic mode.

11. The claim according to claim 8 where the microphone array further includes a configurable pickup pattern for the beamforming.

12. The claim according to claim 8 where the microphone array further includes adaptive steering technology.

13. The claim according to claim 8 where the microphone array further includes adjustable noise cancellation.

14. The claim according to claim 8 where the microphone array further includes adaptive acoustic processing that automatically adjusts to the room configuration for audio pickup.

15. A method to use a band-limited microphone array with beamforming and acoustic echo cancellation, comprising:

resolving first audio input signals within a first frequency range with a plurality of first microphones configured as a microphone array and used for beamforming, the microphone array includes acoustic echo cancellation, the plurality of microphones of the microphone array are positioned at predetermined locations, the microphone array picks up audio input signals;

resolving second audio input signals within a restricted second frequency range with one or more additional non-beamforming microphone(s) coupled to the microphone array;

executing software program steps using augmented beamforming that processes audio signals from the microphone array and the additional non-beamforming microphone(s) where the augmented beamforming further includes: receiving the resolved first audio signals from the microphone array, receiving the resolved and restricted second audio input signals, performing beamforming on the received and resolved first audio input signal, combining the beamformed first audio input signal with the resolved and restricted second audio input signals to create an audio signal within a band-limited frequency range.

16. The claim according to claim 15 that further comprises a microphone gating algorithm configured to apply attenuation to the resolved and restricted second audio input signal.

17. The claim according to claim 15 where the microphone array further includes a last mic mode.

18. The claim according to claim 15 where the microphone array further includes a configurable pickup pattern for the beamforming.

19. The claim according to claim 15 where the microphone array further includes adaptive steering technology.

20. The claim according to claim 15 where the microphone array further includes adjustable noise cancellation.

21. The claim according to claim 15 where the microphone array further includes adaptive acoustic processing that automatically adjusts to the room configuration for audio pickup.

22. A non-transitory program storage device readable by a computing device that tangibly embodies a program of instructions executable by the computing device to perform a method to use a band-limited microphone array with beamforming and acoustic echo cancellation, comprising:

resolving first audio input signals within a first frequency range with a plurality of first microphones configured as a microphone array used for beamforming processing, the microphone array further includes acoustic echo cancellation, the plurality of microphones of the microphone array are positioned at predetermined locations, the microphone array picks up audio input signals;

resolving second audio input signals within a restricted second frequency range with one or more non-beamforming additional microphone(s) coupled to the microphone array;

executing software program steps using augmented beamforming that processes audio signals from the microphone array and the additional non-beamforming microphone(s) where the augmented beamforming further includes: receiving the resolved first audio signals from the microphone array, receiving the resolved and restricted second audio input signals, performing beamforming on the received and resolved first audio input signal, combining the beamformed first audio input signal with the resolved and restricted second audio input signals to create an audio signal within a band-limited frequency range.

23. The claim according to claim 22 that further comprises a microphone gating algorithm configured to apply attenuation to the resolved and restricted second audio input signal.

24. The claim according to claim 22 where the microphone array further includes a last mic mode.

25. The claim according to claim 22 where the microphone array further includes a configurable pickup pattern for the beamforming.

26. The claim according to claim 22 where the microphone array further includes adaptive steering technology.

27. The claim according to claim 22 where the microphone array further includes adjustable noise cancellation.

28. The claim according to claim 22 where the microphone array further includes adaptive acoustic processing that automatically adjusts to the room configuration for audio pickup.

* * * * *